US005101898A

United States Patent [19]

Hong

[11] Patent Number: 5,101,898

[45] Date of Patent: Apr. 7, 1992

[54] WELL PLACEMENT FOR STEAMFLOODING STEEPLY DIPPING RESERVOIRS

[75] Inventor: Ki C. Hong, Orange, Calif.

[73] Assignee: Chevron Research & Technology Company, San Francisco, Calif.

[21] Appl. No.: 672,256

[22] Filed: Mar. 20, 1991

[51] Int. Cl.[5] ..... E21B 43/24; E21B 43/30

[52] U.S. Cl. ..... 166/245; 166/292

[58] Field of Search ..... 166/245, 263, 272

[56] References Cited

U.S. PATENT DOCUMENTS

| | | | |
|---|---|---|---|
| 3,705,625 | 12/1972 | Whitten et al. | 166/272 X |
| 3,795,278 | 3/1974 | Whitten et al. | 166/272 |
| 4,260,018 | 4/1981 | Shum et al. | 166/272 |
| 4,434,851 | 3/1984 | Haynes, Jr. et al. | 166/272 |
| 4,491,180 | 1/1985 | Brown et al. | 166/272 |
| 4,503,910 | 3/1985 | Shu | 166/272 X |
| 4,597,443 | 7/1986 | Shu et al. | 166/272 |
| 4,610,301 | 9/1986 | Ghassemi et al. | 166/272 X |
| 4,627,493 | 12/1986 | Alameddine | 166/272 X |

*Primary Examiner*—George A. Suchfield

*Attorney, Agent, or Firm*—E. A. Schaal; E. J. Keeling

[57] ABSTRACT

Steam is injected in a multi-spot pattern in a dipping reservoir. The injection point of that steam is downdip and is offset from the pattern center by at least one-fifth the distance from the pattern center to the downdip producer row of that pattern. Preferably, the amount of offset is between two-fifths and three-fifths the distance from the pattern center to the downdip producer row.

8 Claims, 3 Drawing Sheets

WELL PLACEMENT FOR STEAMFLOODING STEEPLY DIPPING RESERVOIRS

The present invention relates to steamflooding using a multi-spot pattern in a dipping reservoir.

BACKGROUND OF THE INVENTION

Steamflooding is an enhanced oil recovery method in which saturated or superheated steam is injected into an oil-bearing formation to heat the oil to reduce its viscosity so it will separate from the oil sand and drain into the wellbore. The water from the cooled and condensed steam is pumped out of the well with the oil and is separated at the surface.

Multi-spot patterns are commonly used in steamflooding. By "multi-spot pattern," we mean an areal configuration featuring an injection well and more than one production well that are used for recovery of oil. Examples of multi-spot patterns are 4-spot, 5-spot, inverted 7-spot, and inverted 9-spot patterns. In five-spot pattern, four production wells are located in a square pattern with the injection well in the center, a layout similar to a five-of-spades playing card.

These patterns have also been used for dipping reservoirs, while ignoring the effect of dip on steamflood performance. By "dip," we mean the angle that a geological stratum makes with a horizontal plane (the horizon); the inclination downward or upward of a stratum or bed. A five-spot pattern is more commonly used for steamflooding dipping reservoirs because it becomes a middle-staggered line drive if one side of the pattern is aligned with the direction of dip. By "dipping reservoir," we mean a reservoir that intersects a horizontal plane at an angle greater than 5 degrees. By "steeply dipping reservoir," we mean a reservoir that intersects a horizontal plane at an angle greater than 10 degrees.

One approach for steamflooding steeply dipping reservoirs is disclosed by Yick-Mow Shum in U.S. Pat. No. 4,260,018, entitled "Method for steam injection in steeply dipping formations," which is hereby incorporated by reference for all purposes. In that approach, steam breakthrough at the updip outcrop of a steeply dipping heavy oil reservoir is prevented by the injection of a hot water bank above the point at which the steam is injected into the heavy oil reservoir.

Another approach is disclosed by Stewart Haynes, Jr. et al. in U.S. Pat. No. 4,434,851, entitled "Method for steam injection in steeply dipping formations," which is hereby incorporated by reference for all purposes. In that approach, steam is injected in a lower portion of the reservoir and cold water is injected in an updip portion of the reservoir.

A third approach is disclosed by Bassem R. Alameddine in U.S. Pat. No. 4,627,493, entitled "Steamflood recovery method for an oil-bearing reservoir in a dipping subterranean formation," which is hereby incorporated by reference for all purposes. In that approach, steam injection wells are located up-dip and down-dip of each oil-bearing reservoir. Some time after steam breakthrough in the upper-most one of the production wells, this well is converted to a steam injection well, and the original up-dip steam injection well is shut in. Some time after steam breakthrough in the lower-most one of the production wells, this well is converted to a steam injection well, and the original down-dip steam injection well is shut-in. Some time after steam breakthrough occurs at the remaining up-dip and down-dip production wells, these wells are sequentially converted to steam injection wells, and the preceding up-dip and down-dip steam injection wells are shut in.

A recent simulation study of steamflooding in a steeply dipping reservoir has shown that, because of gravity, the injected steam becomes unevenly distributed between the updip and downdip parts of the reservoir. (K. C. Hong, "Effects of Gas Cap and Edgewater on Oil Recovery by Steamflooding in a Steeply Dipping Reservoir," SPE 20021,1990) Steam preferentially flows updip, causing early steam breakthrough to the updip producer while the downdip producer remains cold. This imbalance of steam flow produces poor areal and vertical sweep by steam and reduces steamflood efficiency.

SUMMARY OF THE INVENTION

The present invention provides a method of steamflooding in a multi-spot pattern in a dipping reservoir. This method involves injecting steam at a steam injection point offset downdip from the pattern center. The amount of offset is at least one-fifth the distance from the pattern center to the downdip producer row of that pattern. In one embodiment, the amount of offset is between two-fifths and three-fifths the distance from the pattern center to the downdip producer row. Preferably, the multi-spot pattern is a five-spot pattern.

One can reduce steam channeling after steam breakthrough in this method by reducing the rate of heat injection after said steam breakthrough. This can be done by reducing the mass rate of steam injection after steam breakthrough to between one-quarter and three-quarters of the average mass rate of steam injection prior to steam breakthrough. Or it can be done by reducing the quality of the injected steam after steam breakthrough to between one-quarter and three-quarters of the average quality of the injected steam prior to said steam breakthrough.

The method can be applied to a dipping reservoir in more than one multi-spot pattern. In that case steam is injected in each pattern at a steam injection point downdip from the pattern center and offset from the pattern center by at least one-fifth the distance from the pattern center to the downdip producer row of that pattern. The amount of offset for each injection point can vary for each pattern.

BRIEF DESCRIPTION OF THE DRAWINGS

In order to assist the understanding of this invention, reference will now be made to the appended drawings. The drawings are exemplary only, and should not be construed as limiting the invention.

FIG. 2 shows the curves for cases of the injector at pattern center, 1/5 downdip, 2/5 downdip, and 3/5 downdip. FIG. 3 shows the curves for cases of the injector at pattern center, 3/5 downdip, 4/5 downdip, and 5/5 downdip.

DETAILED DESCRIPTION OF THE INVENTION

Figure 1:
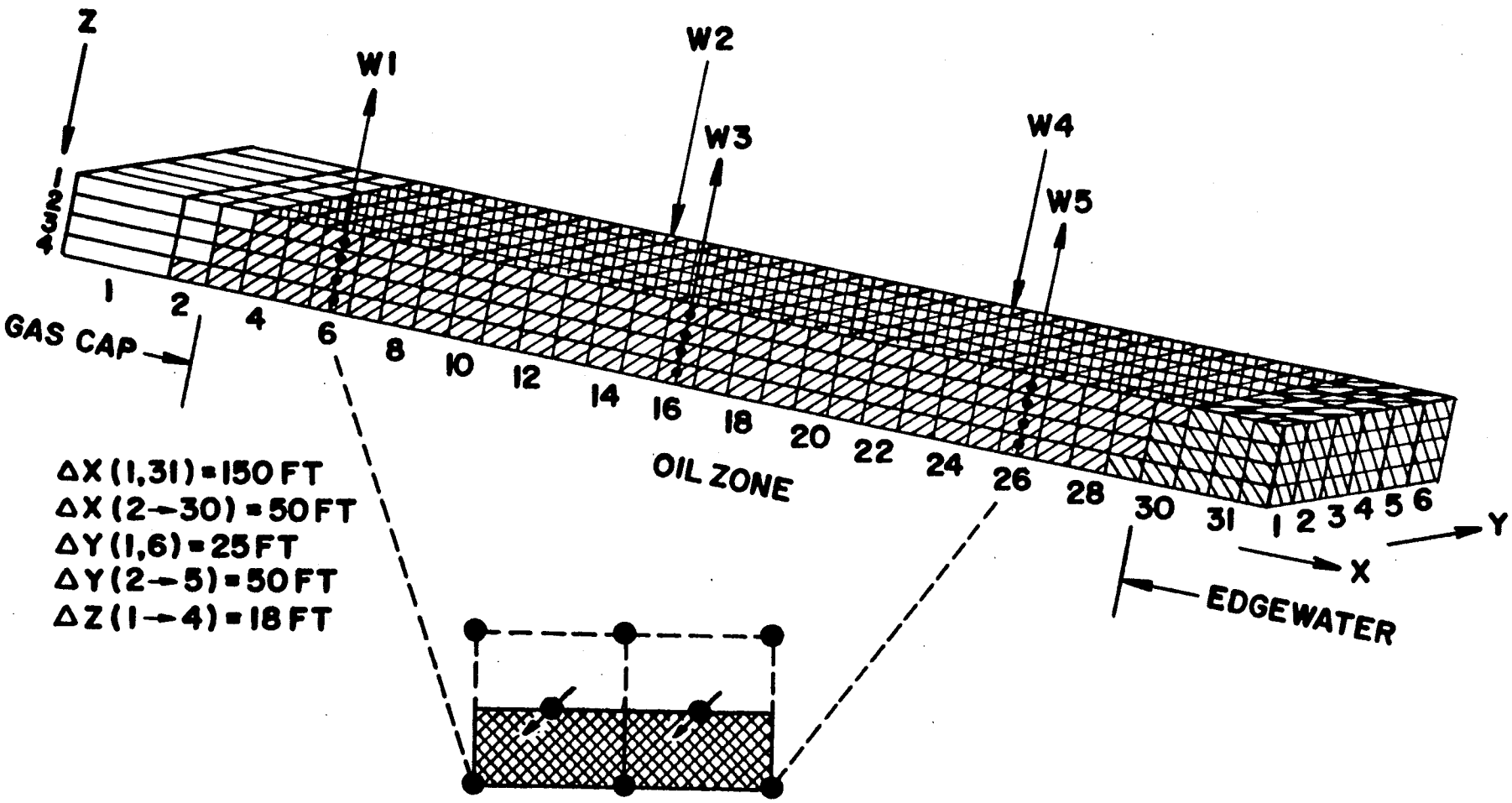
FIG. 1 shows the three-dimensional reservoir model used in this study.

In dipping reservoirs, steamflooding seems to favor the higher portions of the reservoir. Traditionally, steamflooding occurs in five-spot patterns, with steam injection in the center of the five-spot pattern. The problem with this is that the updip wells have breakthrough before the downdip wells.

In its broadest aspect, the present invention involves offsetting the injection point closer to the downdip producers. The amount of offset is at least one fifth the distance between the center of the pattern and the downdip row of producers. The best location is between two and three fifths of the distance between the center of the pattern and the downdip row of producers. In a field having a multitude of patterns, one doesn't have to have the same offset in each pattern.

By placing the injectors downdip from their respective pattern centers, the injected steam can be distributed more evenly between the updip and downdip directions within each pattern. As a result, steam breakthrough to the updip producers is delayed and the steamflood efficiency is improved.

By "steam injection point," we mean a location of a well on an areal plane where the injectant steam is introduced.

By "pattern center," we mean the point in the pattern about which all points of the pattern exactly balance each other. In a five-spot pattern, the pattern is usally square or rectangular, and the center is where the diagonals of the pattern cross.

By "offset," we mean displaced from a center.

By "downdip producers," we mean production wells that are located downdip from the center of a flood pattern.

By "downdip producer row," we mean a line connecting the producers that are located farthest downdip from the pattern center.

In one embodiment, steam channeling that occurs after steam breakthrough can be reduced by reducing the rate of heat injection after that steam breakthrough. By "steam channeling," we mean the phenomenon of steam traveling through a narrow path within a reservoir from an injector to a producer, rather than as a broad displacement front. By "steam breakthrough," we mean the first appearance of injected steam at a production point.

One way of reducing the rate of heat injection after steam breakthrough is by reducing the mass rate of steam injection. Preferably, the mass rate after steam breakthrough is reduced to between one-quarter and three-quarters of the average mass rate of steam injection prior to steam breakthrough.

Another way of reducing the rate of heat injection after steam breakthrough is by reducing the quality of the steam injected. Preferably, the quality of the injected steam after steam breakthrough is reduced to between one-quarter and three-quarters of the average quality of the injected steam prior to steam breakthrough.

The present invention can be applied to a dipping reservoir in more than one multi-spot pattern. In that case, steam is injected in each pattern at a steam injection point downdip from the center of that pattern and the injection point is offset from the pattern center by at least one-fifth the distance from the pattern center to the downdip producer row of that pattern. The amount of offset for each injection point can vary for each pattern.

EXAMPLES

A numerical simulation study was conducted to determine the best injector location for steamflooding steeply dipping reservoirs with five-spot pattern configurations. The model reservoir has either 20° or 45° dip, is bounded by an updip gas cap and a downdip edgewater, and is steamflooded with one, two, or three five-spot patterns in the direction of dip.

The study showed that steamflood performance in dipping reservoirs can be improved by placing the injector downdip from the pattern center. The best injector location for most situations was found to be about halfway between the pattern center and the downdip producer row. This off-center, downdip steam injection produces the highest steamflood oil recovery among all injection locations considered in the simulation study.

FIG. 1 shows the three-dimensional reservoir model used in this study, representing steamflood development with two five-spot patterns in the direction of dip. The base model places the injectors at the pattern centers so that, when viewed in the direction perpendicular to the bedding plane, the injector and two corner producers represent one-half of a five-spot pattern. Both the gas cap and edgewater were represented by a 150-ft. long outer block and a 50-ft. long inner block.

As shown in FIG. 1, wells W1, W3, and W5 are production wells (as shown by the upward arrows) and wells W2 and W4 are injection wells (as shown by the downward arrows). As shown in the bottom of FIG. 1, wells W1, W2, and W3 form one-half of a five-spot pattern, and wells W3, W4, and W5 form one-half of an adjacent five-spot pattern. As shown in the legend of FIG. 1, the $\Delta x$ is 150 feet for the 1st and 31st blocks in the x direction, and 50 feet for all other blocks. The $\Delta y$ is 25 feet for the 1st and 6th blocks in the y direction, and 50 feet for all other blocks. The $\Delta z$ is 18 feet for all blocks.

Pressure varied with depth according to the hydraulic gradient, whereas saturations were different for different parts of the reservoir. In the gas cap, both the initial gas and water saturations were 45%; in the aquifer, the initial gas and water saturations were 0 and 90%, respectively. The initial oil saturation in the gas cap or edgewater was assumed to be 10%, a value below the residual saturation to hot waterflood or gasflood. In the oil zone, both oil and water saturations were 50%.

The optimum injector location within a given flood pattern is the one that accelerates oil production early in a flood life and produces the highest oil recovery. The injector should be located downdip from the pattern center to distribute injected steam more evenly and thus to improve steamflood oil recovery. The optimum injector location was determined by comparing the cumulative recovery curves obtained with the injector placed in different grid blocks between the pattern center and the downdip producer row on the far side of the model.

Figure 2:
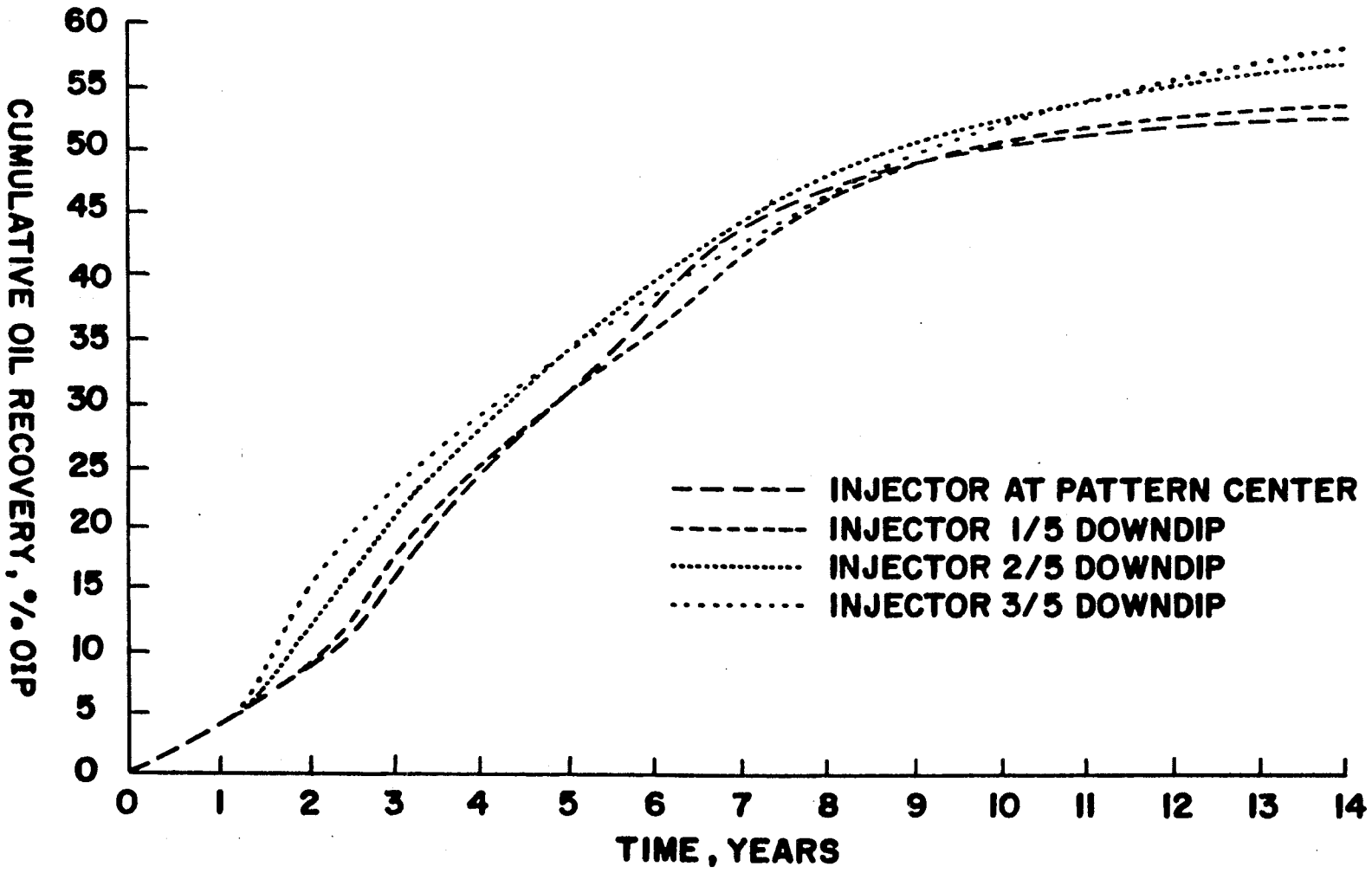
FIGS. 2 and 3 show the cumulative oil recovery as affected by injection well location in a steeply dipping reservoir (20°) with two injectors and three producer rows.
Figure 3:
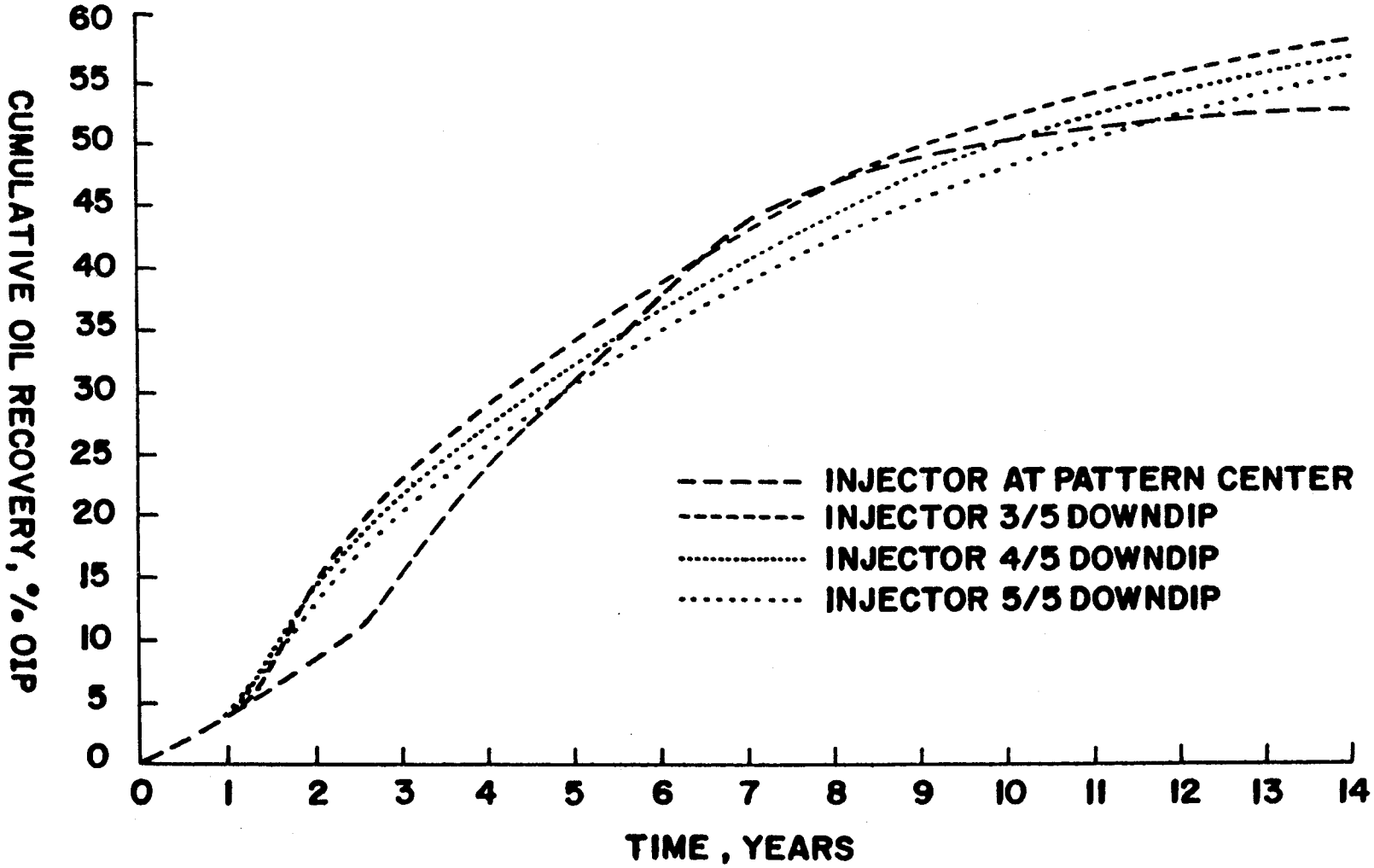

FIGS. 2 and 3 show the cumulative recovery curves that result from the simulation. Those curves show that the cumulative oil recovery at 14 years increases as the distance between the injector and the pattern center increases, until the recovery reaches a maximum. That maximum is reached when the injectors are moved two or three blocks down from their respective pattern centers. The recovery then decreases as the injector is moved farther downdip. FIGS. 2 and 3 further show that the injector placed two or three blocks downdip from the pattern center accelerates the production more than any other injector location. Thus, to maximize the production acceleration and the ultimate recovery, the injector must be located about halfway between the pattern center and the downdip producer row.

For the base case, with injectors at their respective pattern centers, the two separate steam zones grow preferentially in the updip direction because of gravity. Since there is no confinement in the updip direction, steam soon breaks through to the updip producer, causing the early production response. Similarly, steam injected into the downdip injector propagates updip and simultaneously breaks through to the onstrike producer at about the same time when steam injected into the updip injector breaks through to the updip producer. The downdip producer remains cold, as steam injected into the downdip injector moves mainly updip.

Moving the injectors downdip from their pattern centers alters the steam zone propagation and oil displacement by steam. Steam breakthrough at the updip producer is delayed because the distance is increased between the updip injector and the updip producer. At the same time, the distance between the downdip injector and the downdip producer is shortened, causing an earlier response from the downdip producer than was observed with the base case. On the other hand, the production behavior of the onstrike producer changes only slightly from that of the base case because the updip injector moves closer to the onstrike producer, while the downdip injector moves away from it. The source of the main driving force for production at the onstrike well is simply switched from the downdip to updip injector, with little resultant change in cumulative oil production from this well.

The delay in steam breakthrough at the updip producer reduces the wasteful steam production while the earlier production response from the downdip producer accelerates and increases the project oil recovery. As a result, the overall steam-flood efficiency is improved.

To study the sensitivity of optimum injector location to reservoir dip and the number of steamflood patterns in the direction of dip, the base case dip was increased to 45 degrees and the number of flood patterns was decreased or increased by one. For each combination of reservoir dip and the number of patterns, the optimum injector location was determined by the same procedure as that used for the base case.

TABLE I

SENSITIVITY OF OPTIMUM INJECTOR LOCATION TO RESERVOIR DIP AND NUMBER OF FLOOD PATTERNS

| | Number of flood Patterns | | |
|---|---|---|---|
| Reservoir Dip | One | Two | Three |
| 20° | 2/5 | 2/5 or 3/5 | 2/5 or 3/5 |
| 45° | 2/5 or 3/5 | 3/5 | 3/5 |

The table above lists the optimum injector locations for all cases considered. The optimum injector location for most cases is about halfway (2/5 to 3/5 the distance) between the pattern center and the downdip producer row. There is a slight variation of the optimum injector location depending on the reservoir dip and the number of flood patterns in the direction of dip. In general, as the dip and the number of patterns increase, the injector should be located further downdip from the pattern center to maximize steamflood oil recovery.

While the present invention has been described with reference to specific embodiments, this application is intended to cover those various changes and substitutions that may be made by those skilled in the art without departing from the spirit and scope of the appended claims.

What is claimed is:

1. A method of steamflooding in a multi-spot pattern in a dipping reservoir comprising injecting steam at a steam injection point downdip from the pattern center and offset from the pattern center by at least one-fifth the distance from the pattern center to the downdip producer row of that pattern.

2. A method according to claim 1 wherein the amount of offset is between two-fifths and three-fifths the distance from the pattern center to the downdip producer row.

3. A method according to claim 1 wherein the multi-spot pattern is a five-spot pattern.

4. A method according to claim 1 wherein the dipping reservoir is a steeply dipping reservoir.

5. A method of reducing steam channeling after steam breakthrough occurs at a producer during steamflooding in a multi-spot pattern in a dipping reservoir, said method comprising:

(a) injecting heat by steam injection at a point downdip from the pattern center and offset from the pattern center by at least one-fifth the distance from the pattern center to the downdip producer row of that pattern; and (b) reducing the rate of heat injection after said steam breakthrough.

6. A method of reducing steam channeling according to claim 5 wherein the mass rate of steam injection after steam breakthrough is reduced to between one-quarter and three-quarters of the average mass rate of steam injection prior to steam breakthrough.

7. A method of reducing steam channeling according to claim 5 wherein the quality of the injected steam after steam breakthrough is reduced to between one-quarter and three-quarters of the average quality of the injected steam prior to said steam breakthrough.

8. A method of injecting steam in a dipping reservoir in more than one multi-spot pattern comprising injecting steam in each pattern at a steam injection point downdip from the pattern center and offset from the pattern center by at least one-fifth the distance from the pattern center to the downdip producer row of that pattern, wherein the amount of offset for each injection point varies for each pattern.

* * * * *